US005494184A

United States Patent [19]

Noguchi et al.

[11] Patent Number: 5,494,184

[45] Date of Patent: Feb. 27, 1996

[54] CAN TOP WITH AN OVERTURNABLE TAB

[75] Inventors: Akira Noguchi; Jiro Arii; Ichiro Yonezawa, all of Yokohama; Sadao Nishiyama, Sunto; Hiroaki Kitagawa, Sunto; Hiroyuki Murai, Sunto, all of Japan

[73] Assignees: Mitsubishi Materials Corporation; Kirin Beer Kabushiki Kaisha, both of Tokyo, Japan

[21] Appl. No.: 267,522

[22] Filed: Jun. 29, 1994

[30] Foreign Application Priority Data

Jun. 30, 1993 [JP] Japan ..... 5-187149

[51] Int. Cl.[6] ..... B65D 17/34

[52] U.S. Cl. ..... 220/269; 220/271; 220/906

[58] Field of Search ..... 220/268, 269, 220/271, 273, 906

[56] References Cited

U.S. PATENT DOCUMENTS

| | | | |
|---|---|---|---|
| 4,402,421 | 9/1983 | Ruemer, Jr. | 220/269 |
| 4,446,985 | 5/1984 | Dickson | 220/269 |
| 5,011,037 | 4/1991 | Moen et al. | 220/271 |
| 5,285,919 | 2/1994 | Recchia | 220/271 |

FOREIGN PATENT DOCUMENTS

| | | |
|---|---|---|
| 1532081 | 11/1978 | United Kingdom . |
| 2265597 | 10/1993 | United Kingdom . |

*Primary Examiner*—Gary E. Elkins
*Assistant Examiner*—Nathan J. Newhouse
*Attorney, Agent, or Firm*—Oblon, Spivak, McClelland, Maier & Neustadt

[57] ABSTRACT

A can top end includes a disc-shaped panel having a disc-shaped flat section an outer periphery to be engaged with an upper end of a can body, and a stay-on type tab attached on the flat section of the panel. The disk-shaped flat section has a primary score to define a primary scored portion surrounded by the primary score and the flat section further includes a secondary score to define a secondary scored portion surrounded by the secondary score. The tab has a connecting portion rotatably connected to a center portion of the flat section around an axis perpendicular to the flat section and the tab has both a pull-up end and a push-down end. The primary scored portion is located below the push-down end of the tab to enable the primary scored portion to be opened by pulling up the pull-up end of the tab. The secondary scored portion is located at a position facing the push-down end of the tab when the tab is rotated to a predetermined angle from an initial position, so that the secondary scored portion is opened by pulling up the pull-up end of the tab.

14 Claims, 8 Drawing Sheets

CAN TOP WITH AN OVERTURNABLE TAB

BACKGROUND OF THE INVENTION

1. Field of the Invention

The present invention relates to a top end of a can having a stay-on-type tab, and more particularly, to a top end which is suitable for a beverage can.

2. Discussion of the Background

FIGS. 13 and 14 show a conventional can top end 2. This top end 2 consists of a disc-shaped panel 4 and a stay-on-type tab 10 fixed on the center of the panel 4, and the outer periphery of the panel 4 can be engaged to the upper end of a can body in a can-manufacturing process. Both panel 4 and tab 10 are commonly made of aluminum alloy.

The panel 4 has a C-shaped score 6 and a scored portion 8 surrounded by the score 6 in the upper surface thereof. The score 6 was formed by shallowly scoring the upper surface of the panel 4, and the score 6 starts from an adjacent point of the center portion of the panel 4, passes an adjacent point of the outer periphery of the panel 4, and terminates at the adjacent point of the center portion of the panel 4. In general, the score 6 consists of two parallel scores 61 and 62. The outer score 61 is the main score to be torn by pulling up the tab 10, and the inner score 62 is an auxiliary score which facilitates the tearing of the outer score 61.

The tab 10 has a pull-up end **10*b* and a push-down end 10*a* at both ends thereof. The push-down end 10*a* is located on the scored portion 8. Thus, the outer score 61 can be torn by pulling up the pull-end 10*b* of the tab 10, and thus, the scored portion 8 is opened. The tab 10 is fixed to the panel 4 as shown in FIG. 14. That is, in the center of the panel 4, a protrusion 12 is formed, and the protrusion 12 is riveted through a connecting hole of the tab 10**.

According to the above-mentioned top end 2, it Is possible to open the scored portion 8 without detaching the tab 10 from the top end 2. However, it has been pointed out that the top end 2 of this type makes it difficult to drink the contents of a can, in comparison with a top end having a detachable tab.

The reasons of this difficulty are as follows.

1) In the above-described top end 2, after the scored portion 8 is opened by pulling up the tab 10, the push-down end **10*a* of the tab 10 protrudes inside the opening. Therefore, when a person drinks the contents of the can, the tab 10** comes into contact with the person's nose or upper lip and prevents fitting of the lips around the periphery of the opening.

2) In the top end 2, as the area of the scored portion 8 becomes larger, the force which is necessary to tear open the scored portion 8 increases. Therefore, in order to facilitate the opening operation, the scored portion 8 should be relatively small. Thus, inflow of air into the can is restricted by the small size of the opening of the can end 2, and outflow of the contents is hindered.

Additionally, in the recent years, it has been desirable to reduce the diameter of the top end 2 in order to reduce manufacturing costs. However, if the diameter of the top end 2 Is made smaller, the distance between the push-down end **10*a* of the tab 10 and the outer periphery of the top end 2 becomes small, and interference of the tab 10 with the nose or lip of a drinker is increased. Furthermore, if the size of the scored portion 8 is made smaller in order to reduce the diameter of the top end, it becomes more difficult to smoothly drink the contents of the can. Therefore, the conventional top end 2** is insufficient to meet the demands of reducing the manufacturing costs of cans.

SUMMARY OF THE INVENTION

In view of the above, an object of the present invention to provide a can top end which makes it easier to drink the contents of the can.

In order to achieve this object, the can top end of the present invention comprises:

a disc-shaped panel comprising a disc-shaped flat section and an outer periphery to be engaged with an upper end of a can body, the disk-shaped flat section having a primary score to define a primary scored portion surrounded by the primary score, the flat section further having a secondary score to define a secondary scored portion surrounded by the secondary score; and a stay-on-type tab provided on the flat section having a connecting portion rotatably connected to a center portion of the flat section around an axis perpendicular to the flat section, the tab having a pull-up end and a push-down end.

The primary scored portion is located below the push-down end of the tab to enable the primary scored portion to be opened by pulling up the pull-up end of the tab. The secondary scored portion is located at a position facing the push-down end of the tab when the tab is rotated to a predetermined angle from an initial position, so that the secondary scored portion is opened by pulling up the pull-up end of the tab.

In order to open the can top end of the present invention, the pull-up end of the tab is first pulled up to push down the primary scored portion inside the can. Thereby, a primary opening is formed, enabling the consumption of the contents of the can. Next, the tab is returned to the horizontal position, and is horizontally rotated to a predetermined angle from the initial position so that the push-down end of the tab faces the secondary scored portion. In this position, the pull-up end of the tab is pulled up again, and thus, the secondary scored section is pushed down and a secondary opening is formed. After opening the secondary scored portion, the pull-up end of the tab is further pushed up and overturned toward the side of the secondary scored portion so that the push-down end is inserted into the secondary opening.

By the above-described operation, since the tab is turned over opposite the primary opening with the push-down end being inserted into the secondary opening, the push-down end of the tab does not protrude inside the primary opening. Therefore, it is possible to prevent interference of the tab with the nose or lips of the drinker, and drinking of the contents is thereby facilitated.

Furthermore, since the secondary scored portion is also open, air can flow into the can through the secondary opening during the drinking of the contents, and this facilitates the outflow of the contents from the primary opening.

Additionally, according to the can top end of the present invention, it is possible to reduce the diameter of the top end while facilitating consumption of the contents of the can. Therefore, it is possible to reduce the amount of the material used for the can top end, and a reduction of the manufacturing costs thereof is possible.

The flat section may have a protrusion formed on the center portion, and the protrusion may be riveted through the connecting portion of the tab so as to connect the tab to the panel in a rotatable manner.

According to this construction, it is possible to rotatably attach the tab to the panel at a low cost, thus enabling a reduction of the manufacturing costs of the can top end.

The secondary scored portion may be formed below the tab located at the initial position. In this case, should tearing of the secondary score unexpectedly occur, the tab hinders jetting out of the contents of the can from the gap in the secondary score. Therefore, it is possible to prevent spraying out of the contents of the can.

The secondary scored portion can be formed opposing the primary scored portion with the connecting portion of the tab disposed between the primary scored portion and the secondary scored portion.

According to this configuration, since the distance between the primary scored portion and the secondary scored portion is maximal, it is possible to form the primary scored portion and the secondary scored portion in large sizes. Therefore, the case of drinking can be improved.

The secondary scored portion may have an area which is smaller than that of the primary scored portion. In this construction, the force necessary for opening the secondary scored portion is smaller than that for opening the primary scored portion. Accordingly, it is not necessary to improve the attachment strength of the tab to the panel in comparison with the conventional top end.

The secondary score may have a semicircular shape having a center located at or adjacent to the center portion of the flat section.

The secondary score may have a U-shape having a bottom part and a pair of side parts, the bottom part elongates substantially parallel to a diameter of the flat section, and each of the side parts respectively elongates from both ends of the bottom part toward an opposite side of the connecting portion.

According to this configuration, it becomes easy to form on the secondary scored portion at least one protrusion for engaging the tab to prevent rotation of the tab. Therefore, unnecessary rotation of the tab before the opening operation is prevented.

The bottom part of the secondary score may have an arc-shaped portion at the middle thereof, and the arc-shaped portion has a center located at or adjacent to the center portion of the flat section. In this case, it Is possible to improve the breaking strength of the secondary score because the distance between the secondary score and the tab-connecting protrusion becomes larger.

The width of the secondary scored portion can be smaller than the width of the tab. According to this construction, when the tab is turned over toward the secondary opening, the pull-down end is held by the inner periphery of the secondary opening. Therefore, it is possible to firmly fix the tab in the overturned position before drinking the contents of the can.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
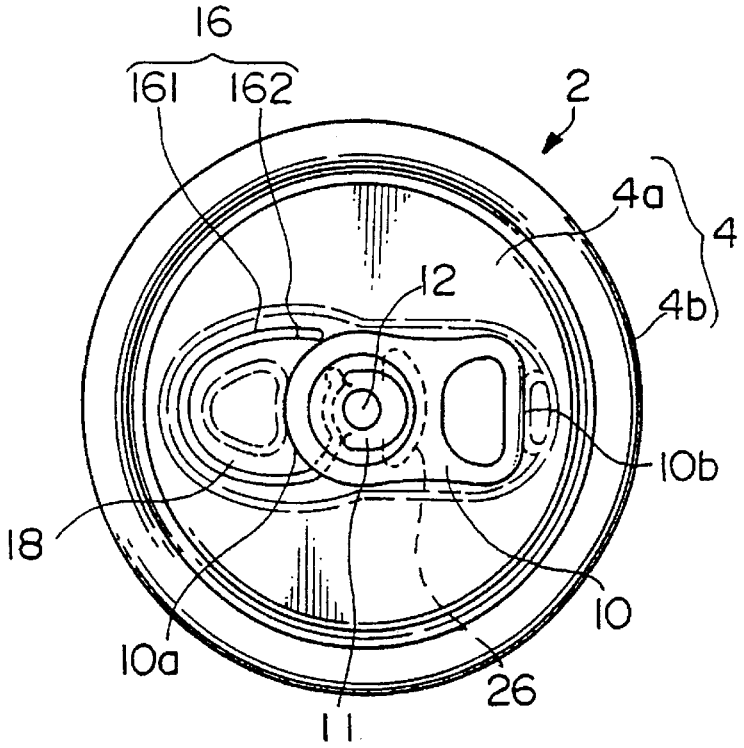
FIG. 1 is a plan view of a top end of a can according to the first embodiment of the present invention.

With reference to FIGS. 1–6, a top end of a can in accordance with the first embodiment of the present invention is illustrated. This top end 2 consists of a disc-shaped panel 4 and a stay-on type tab 10 attached on the panel 4. In general, both panel 4 and tab 10 are made from an aluminum alloy; however, the present invention is not limited to this material. The panel 4 has a disc-shaped flat section **4*a* and an outer periphery 4*b* to be engaged with an upper end of a can body 1, and the tab 10 is fixed on the center portion of the flat section 4*a***.

In the flat section **4*a*, a primary score 16 is formed to define a primary scored portion 18 surrounded by the primary score 16. The primary score 16 is formed by scoring the upper surface of the flat section 4*a* to a small depth. The primary score 16 has a C-shape in this embodiment, and the primary score 16 starts from an adjacent point of the center of the flat section 4*a*, passes an adjacent point of an outer periphery of the flat section 4*a* and terminates at a point adjacent to the starting point thereof. In this embodiment, the primary score 16 in fact consists of two parallel scores 161 and 162. The outer score 161 is a main score to be torn by pulling up the tab 10, and the inner score 162 is an auxiliary score which facilitates the tearing the outer score 161. The configuration of the primary score 16 can be identical to that of a conventional can. However, many modifications of the primary score 16 are possible; for example, the primary score 16** may be U-shaped.

The tab 10 has a pull-up end **10*b* and a push-down end 10*a*, and a connecting projection 11 is formed inside the tab 10. The connecting projection 11 extends from the side of the push-down end 10*a*, and a hole is formed at the center of the connecting projection 11. On the other hand, in the center of the flat section 4*a* of the panel 4, a cylindrical protrusion 12 is formed by press working. The protrusion 12 is inserted through the hole of the connecting projection 11, and is riveted to connect the tab 10 to the flat section 4***a* in a rotatable manner around the protrusion 12. The distance between the protrusion 12 and the pull-up end 10*b* is longer than the distance between the protrusion 12 and the push-down end 10*a*. As shown in FIG. 1, the primary scored portion 18 is located below the push-down end 10*a* of the tab 10 to enable the primary scored portion 18 to be opened by pulling up the pull-up end 10*b* of the tab 10. This position of the tab 10 is defined as an initial position.

Furthermore, in the flat section 4*a*, a secondary score 26 is formed to define a secondary scored portion 28 surrounded by the secondary score 26. The secondary score 26 has a C-shape, and the center of a semicircular part of the secondary score 26 is located at or adjacent to the protrusion 12.

Figure 5:
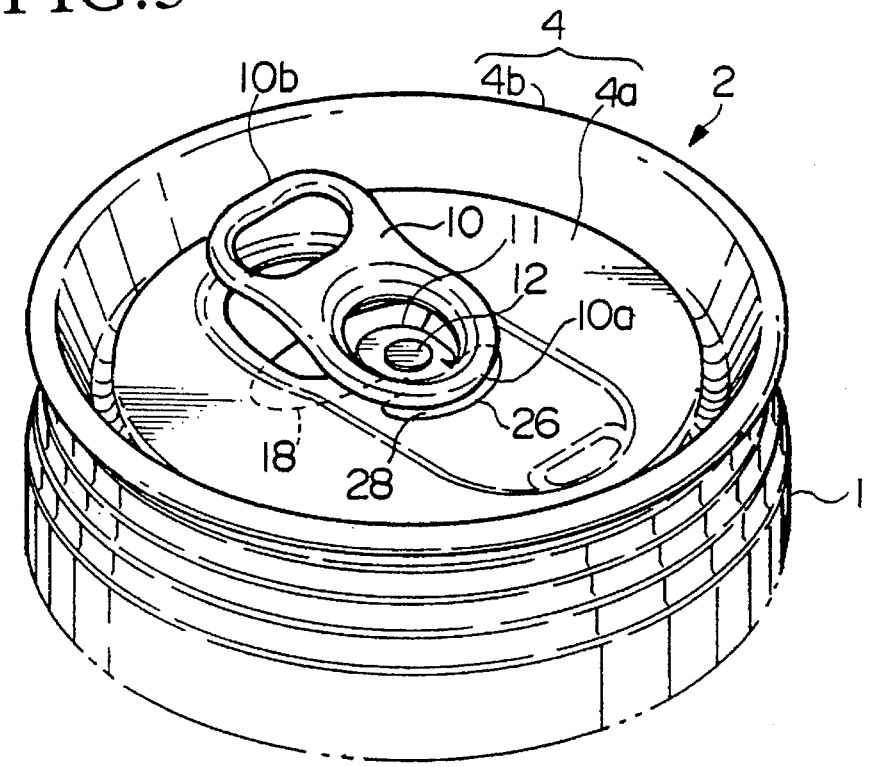
FIG. 5 is a perspective view of the top end of the first embodiment when the tab is rotated.
Figure 6:
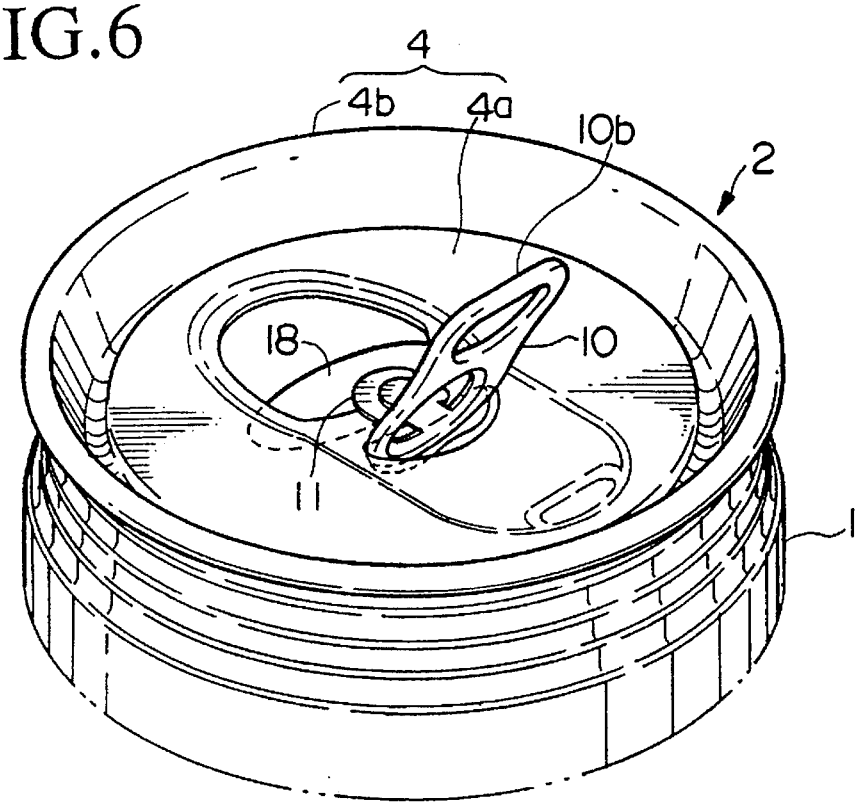
FIG. 6 is a perspective view of the top end of the first embodiment when the secondary scored portion is opened.
Figure 7:
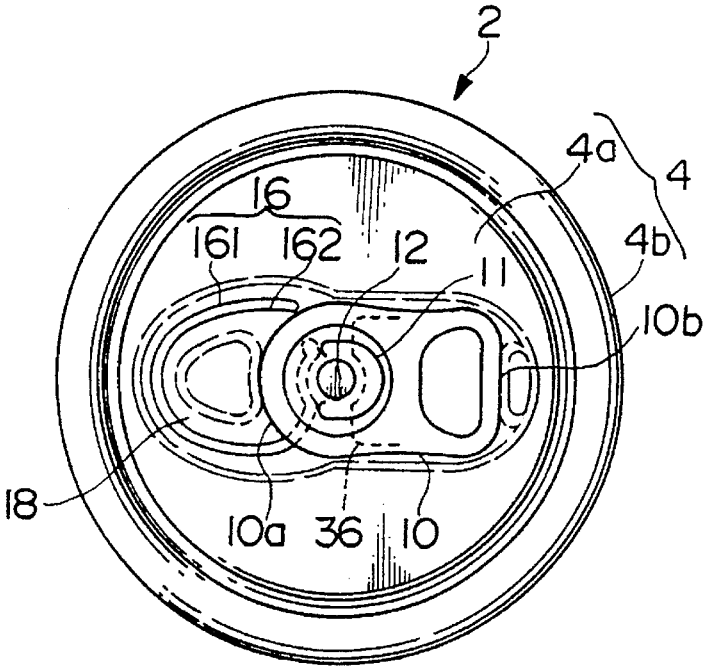
FIG. 7 is a plan view of a top end of a can according to the second embodiment of the present invention.

The secondary scored portion 28 is located diametrically opposing the primary scored portion 18 with the connecting projection 12 disposed between the primary scored portion 18 and the secondary scored portion 28. Therefore, in the case in which the tab is positioned at the initial position, the secondary score 26 and the secondary scored portion are covered by the tab 10. Additionally, in the case where the tab 10 is rotated by 180° from the initial position as shown in FIG. 5, the secondary score 26 is located slightly outside the push-down end 10*a* of the tab 10. Therefore, in this half-rotated position, the secondary scored portion 28 faces the push-down end 10*a* of the tab 10, and thus, it is possible to open the secondary scored portion 28 by pulling up the pull-up end lob of the tab 10, as shown in FIG. 6.

Figure 2:
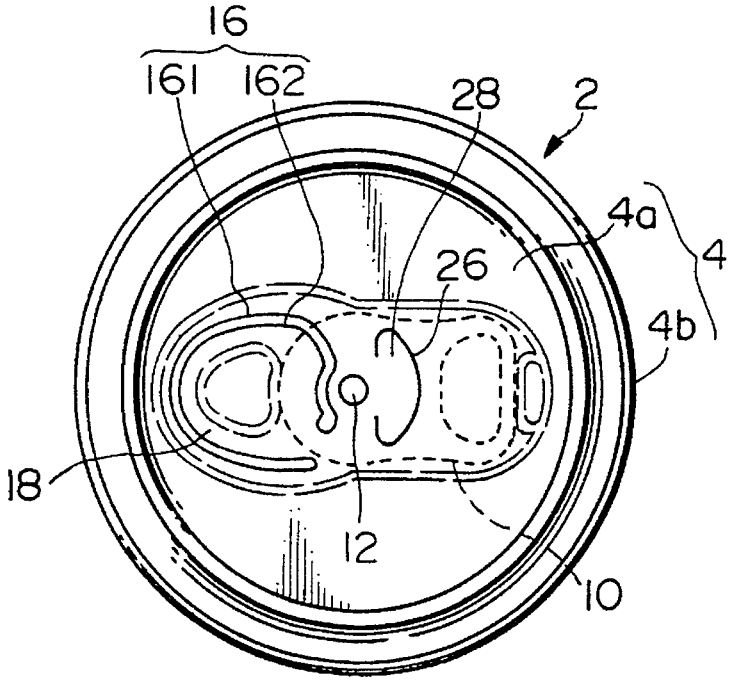
FIG. 2 is a bottom view of the top end of the first embodiment.
Figure 3:
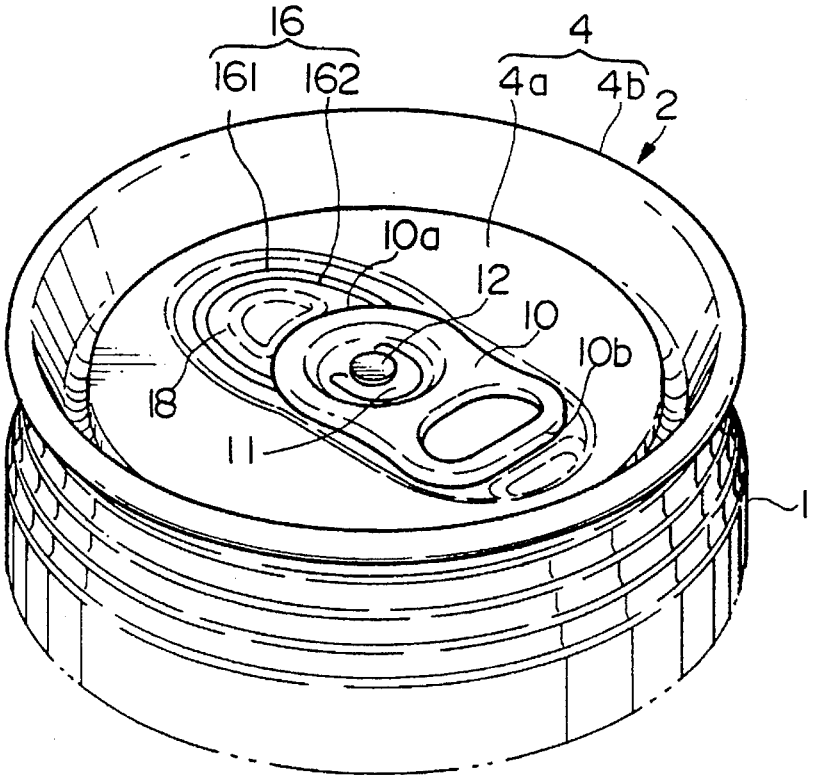
FIG. 3 is a perspective view of the top end of the first embodiment fixed to a can body.

Preferably,-the secondary scored portion 28 has an area which is smaller than that of the primary scored portion 18, and the width W1 of the secondary scored portion is smaller than the width W2 of the primary scored portion 16, as shown in FIGS. 1 and 2.

Figure 4:
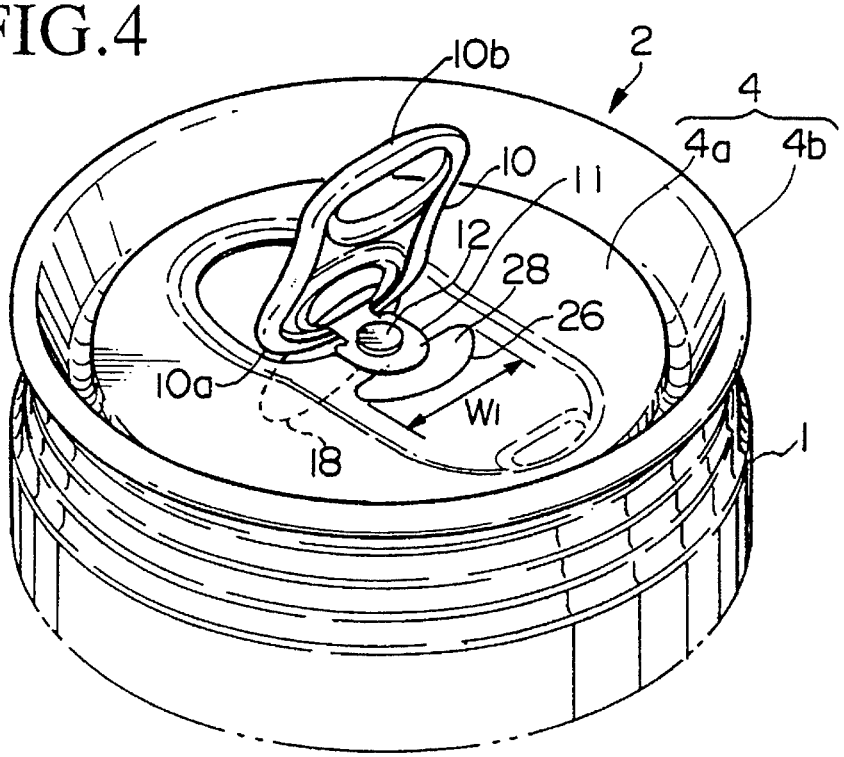
FIG. 4 is a perspective view of the top end of the first embodiment when the primary scored portion is opened.

In order to open the can top end 2 of this embodiment, as shown in FIG. 4, the pull-up end 10*b* of the tab 10 is first pulled up to push down the primary scored portion 18 inside the can, and a primary opening is formed. Then the tab 10 is returned to the horizontal position. The above-described operations are identical to the case of the conventional top end of a can.

Next, as shown in FIG. 5, the tab 10 is horizontally rotated by 180° so that the push-down end 10*a* faces the secondary scored portion 28. Furthermore, as shown in FIG. 6, the pull-up end 10*b* is pulled up again. Thus, the secondary scored section 28 is pushed down with the secondary score 26 being torn, and a secondary opening is formed.

After opening the secondary scored portion 28, the pull-up end 10*b* is further pushed up and overturned toward the opposite side of the primary opening, so that the push-down end 10*a* is inserted into the secondary opening. In this way, a person can drink the contents of the can with the lips fitting the primary opening.

According to the top end 2 of this embodiment, since the tab 10 can be turned over toward the opposite side of the primary opening with the push-down end 10*a* being inserted into the secondary opening, the push-down end 10*a* does not protrude inside the primary opening. Therefore, it is possible to prevent interference of the tab 10 with the nose or lips of the drinker, and drinking of the contents of the can is facilitated.

Furthermore, since the secondary opening is formed at the opposite side of the protrusion 12 relative to the primary opening, air from the exterior of the can flows into the can through the secondary opening when the contents of the can flow out, and this facilitates outflow of the contents from the primary opening. This effect can be similarly obtained in the case where the contents are poured into another container from the can.

Also, for the above reasons, it is possible to reduce the diameter of the top end while obtaining a suitable ease of drinking. Thereby, it is possible to reduce the amount of the material used for the top end, and a lowering of the manufacturing costs thereof is possible.

Furthermore, since the secondary scored portion 28 is formed by only forming the secondary score 26, the top end 2 can be easily manufactured using a modified conventional press die. Therefore, the installation cost for the manufacturing machine can be reduced.

Additionally, since the secondary scored portion 28 has a smaller area than the primary scored portion 18, the secondary scored portion 28 can be opened with less force than is necessary for the primary scored portion 18. Therefore, it is not necessary to improve the attachment strength of the tab 10 to the panel 4 in comparison with the conventional top end.

In addition, because the secondary score 26 is covered by the tab 10 before the opening operation, should tearing of the secondary score 26 unexpectedly occur, for example, due to an increase in the pressure in the can, the tab 10 hinders jetting out of the contents from the secondary score 26. Therefore, it is possible to prevent spraying of the contents from the can.

Furthermore, since the width W1 of the secondary scored portion 28 is smaller than the width of the tab 10, when the tab 10 is turned over toward the secondary opening, the pull-down end 10*a* is held by the inner periphery of the secondary opening. Therefore, it is possible to firmly fix the tab in the overturned position before drinking the contents.

Additionally, in this embodiment, because the secondary scored portion 28 is formed diametrically opposing the primary scored portion 18, the distance between the primary scored portion 18 and the secondary scored portion 28 is maximal. Therefore, it is possible to form both scored portions 18 and 28, respectively, to be of large sizes, and the ease of drinking can be improved.

Next, the second embodiment of the present invention will be described with reference to FIGS. 7–12. In FIGS. 7–12, reference numerals which are identical to those of FIGS. 1–6, respectively, indicate elements which are identical to those of the first embodiment; therefore, explanation thereof will be omitted.

Figure 8:
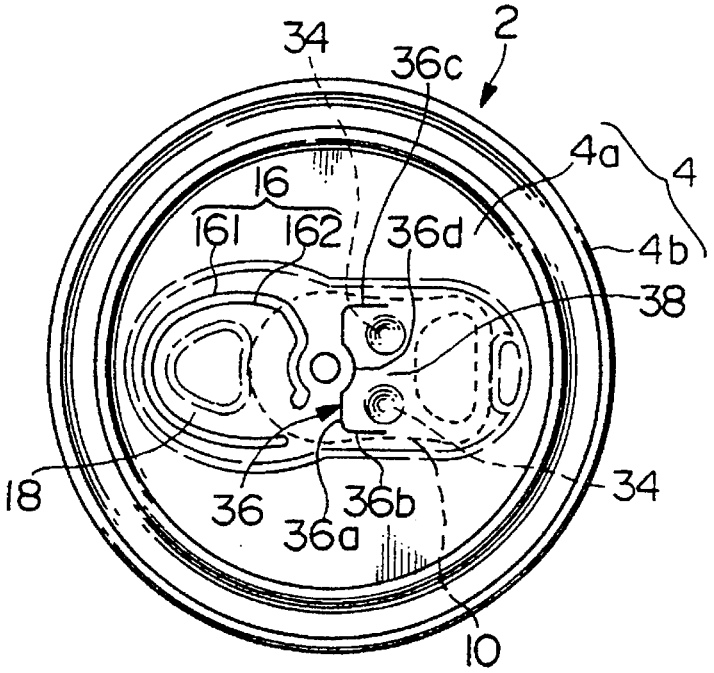
FIG. 8 is a bottom view of the top end of the second embodiment.
Figure 9:
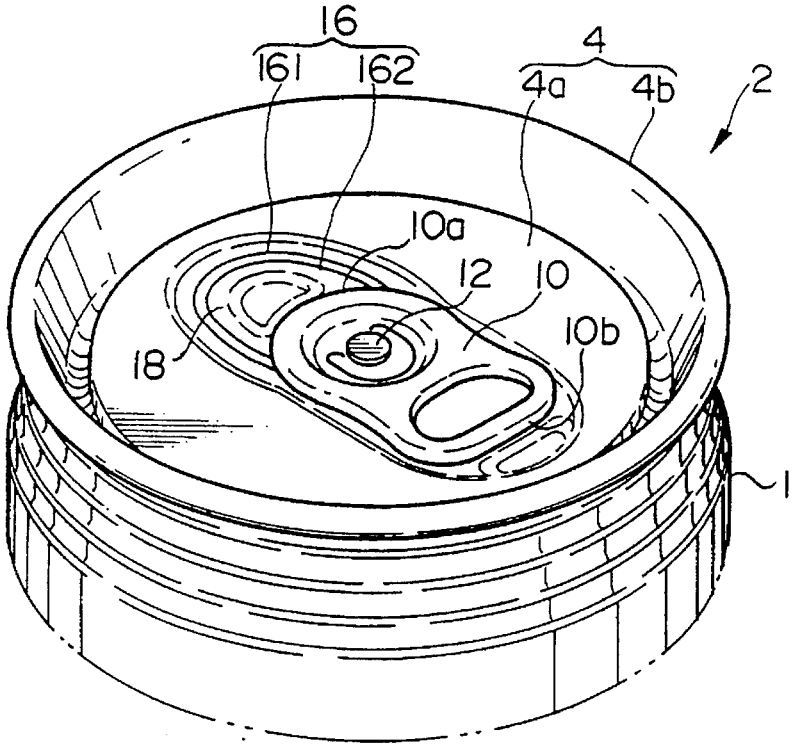
FIG. 9 is a perspective view of the top end of the second embodiment fixed to a can body.
Figure 10:
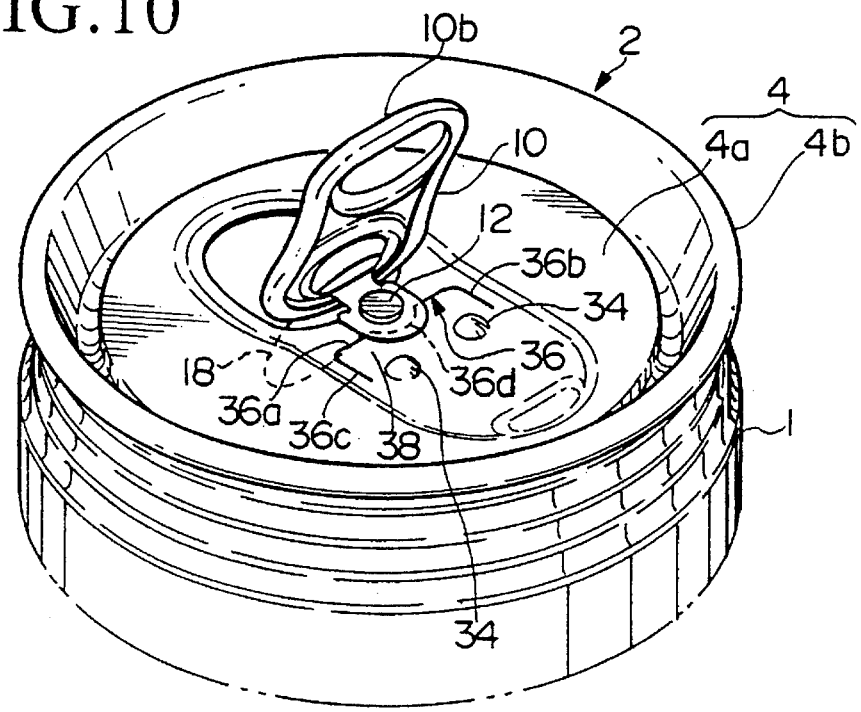
FIG. 10 is a perspective view of the top end of the second embodiment when a primary scored portion is opened.
Figure 11:
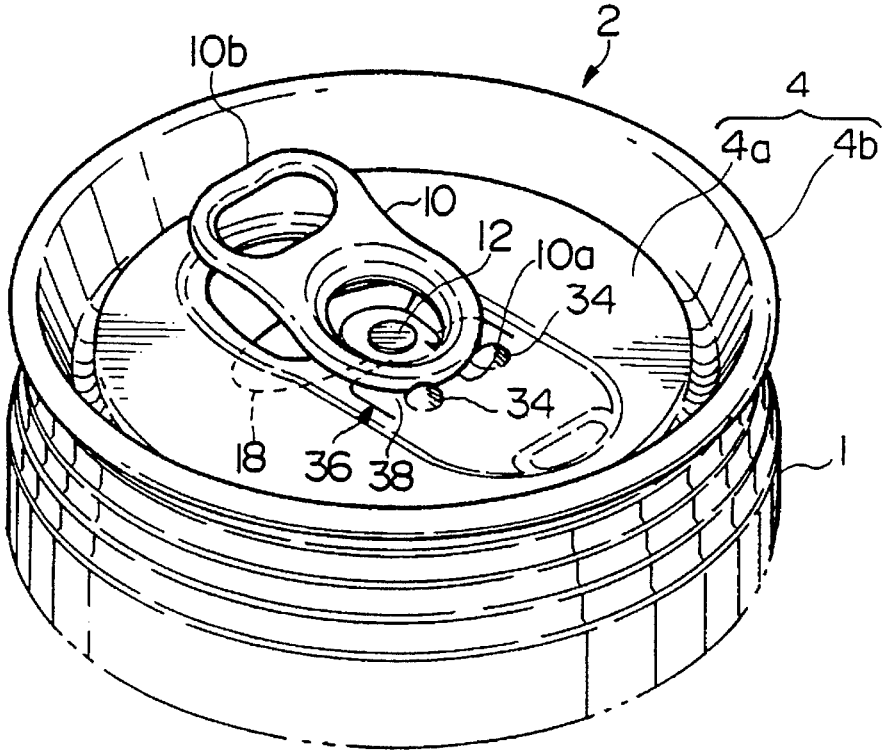
FIG. 11 is a perspective view of the top end of the second embodiment when a tab is rotated.
Figure 12:
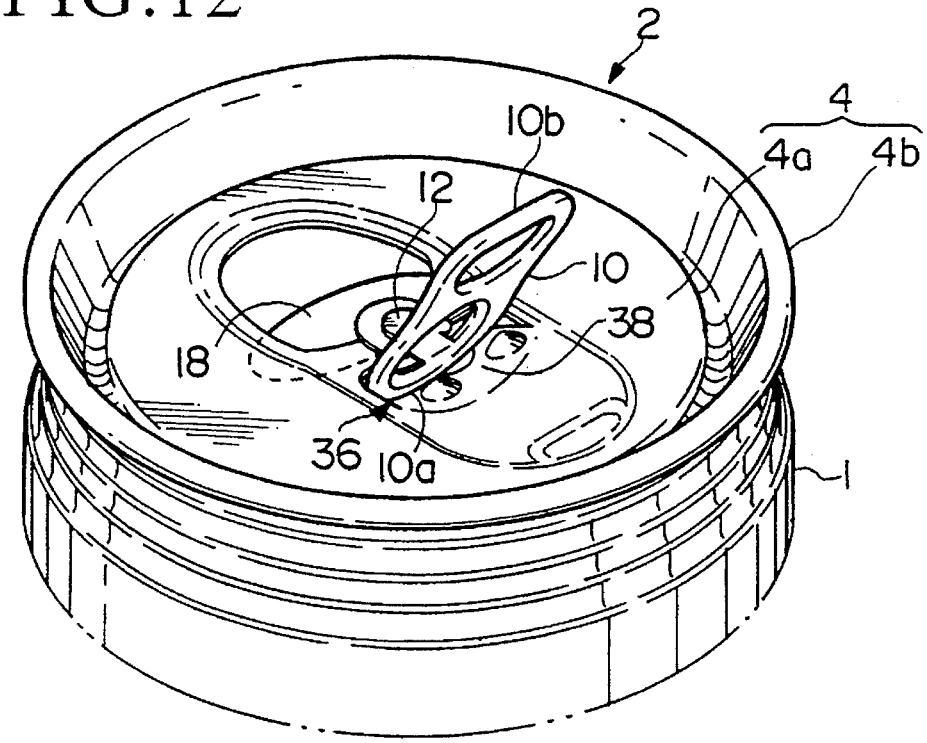
FIG. 12 is a perspective view of the top end of the second embodiment when a secondary scored portion is opened.
Figure 13:
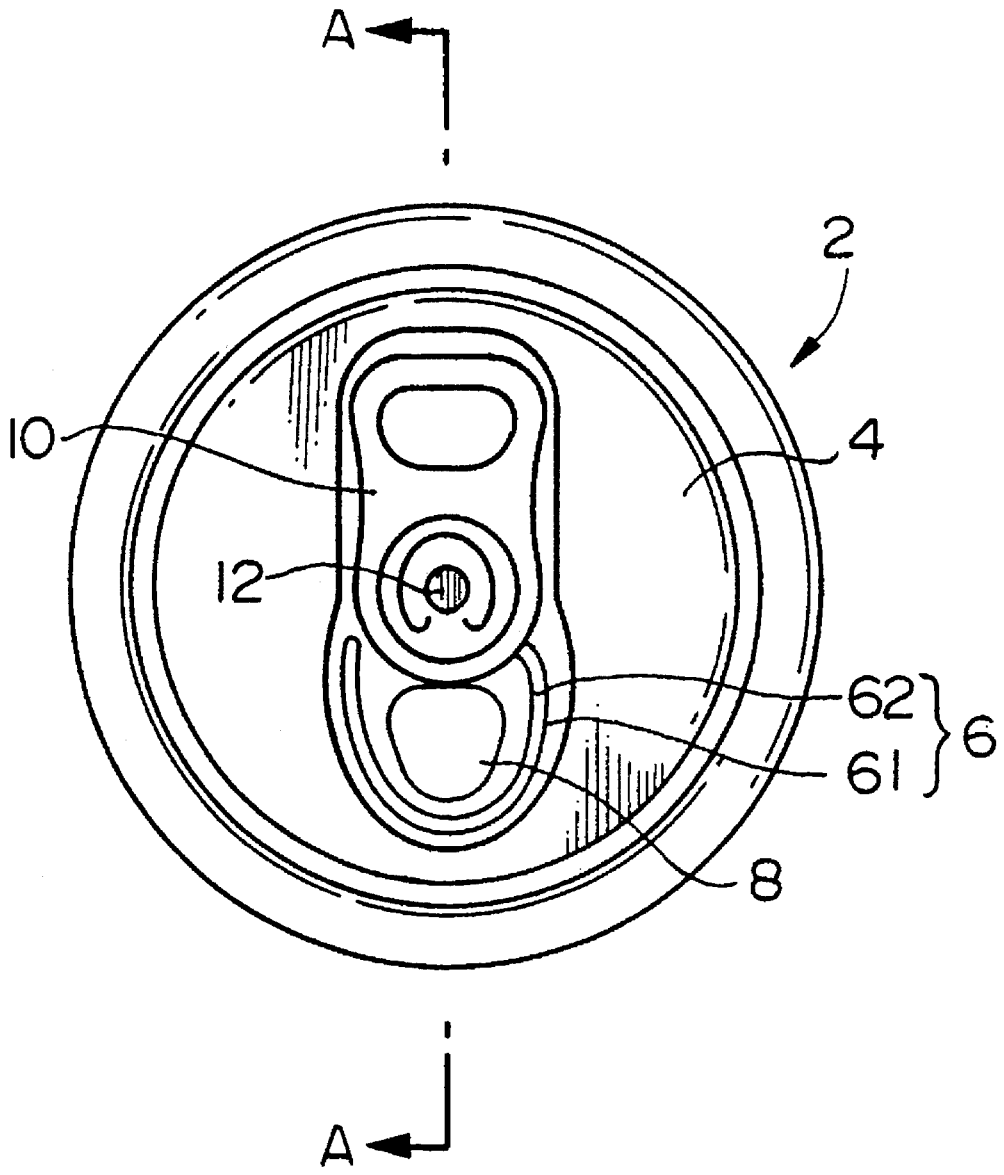
FIG. 13 is a plan view of a top end of a can of the prior art.
Figure 14:
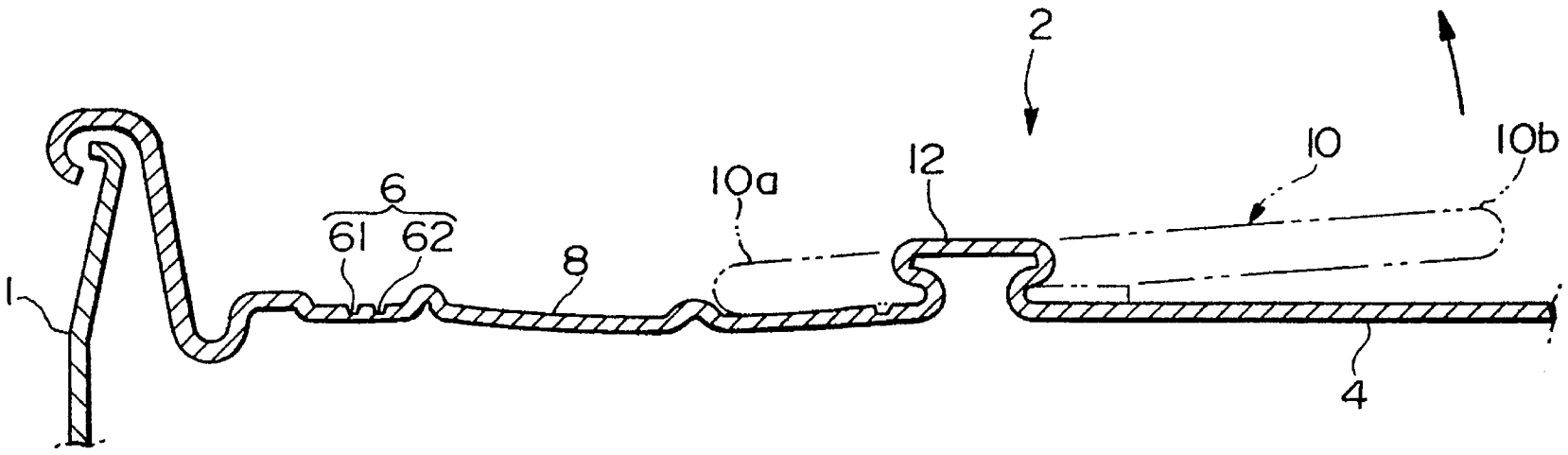
FIG. 14 is a cross section of the top end of the prior art.

This second embodiment differs from the first embodiment in terms of the shapes of the secondary score 36 and the secondary scored portion 38 surrounded by the secondary score 36. As shown in FIG. 8, the secondary score 36 has a wide U-shape having a bottom part 36*a* and a pair of side parts 36*b* and 36*c*. The bottom part 36*a* is elongated perpendicular to the longitudinal direction of the tab 10, and each of the side parts 36*b* and 36*c*, respectively, is elongated from both ends of the bottom part 36*a* toward an opposite side of the connecting protrusion 12. The center part 36*d* of the bottom part 36*a* has an arc-shape whose center is located at or adjacent to the protrusion 12, so that the distance between the center part 36*d* and the protrusion 12 is greater than a predetermined value.

In the second scored portion 38, a pair of protrusions 34, 34 projecting upward are formed by press working. These protrusions 34, 34 engage with the lower surface of the tab 10 when the tab 10 is located at the initial position, and prevent the unnecessary rotation of the tab 10.

The opening operations in this embodiment are identical to those in the first embodiment; therefore, it is possible to obtain the effects identical with those of the first embodiment.

According to this embodiment, since the secondary score 36 has a wide U-shape in which the side parts 36*b* and 36*c* are elongated opposite the protrusion 12, it is possible to form the protrusions 34, 34 engaging with the lower surface of the tab 10. Therefore, it is possible to prevent unnecessary rotation of the tab 10 with high reliability.

Additionally, because the secondary score 36 has the arc-shaped center part 36*d*, it is possible to improve the breaking strength of the secondary score 36. That is, when the protrusion 12 is formed by press working, the thickness of the panel 4 is inevitably slightly thinner along the circumference of the protrusion 12. Therefore, in the case where the arc-shaped center part 36*d* is not formed, the secondary score 36 should pass through the thin portion around the protrusion 12, and the risk would arise that the breaking strength of the secondary score 36 would become insufficient. In contrast, according to this embodiment, it is possible to avoid this risk.

In the above-mentioned two embodiments, the secondary scored portions 28 and 38 are respectively formed opposite the primary scored portions 18. However, the present invention is not limited to this construction, the secondary scored portion may be formed at angles other than 180° with respect to the primary scored portion.

Also, the width of the secondary scored portion may be greater than the width of the tab. Furthermore, various other modifications of the present invention are possible.

What is claimed is:

1. A top end for a can comprising:

a disc-shaped panel comprising a disc-shaped flat section and an outer periphery to be engaged with an upper end of a can body, said disc-shaped flat section having a primary score to define a primary scored portion surrounded by said primary score and which forms a primary opening, said flat section further having a secondary score to define a secondary scored portion surrounded by said secondary score and which forms a secondary opening; and a stay-on type tab provided on said flat section having a connecting portion rotatably connected to a center portion of said flat section around an axis perpendicular to said flat section, said tab having a pull-up end and a push-down end, said tab having a top surface and a bottom surface, said bottom surface of said tab facing said flat section;

wherein said primary scored portion is located below said push-down end of said tab to enable said primary scored portion to be opened by pulling up said pull-up end of said tab, and said secondary scored portion is located at a position facing said push-down end of said tab when said tab is rotated to a predetermined angle from an initial position, so that said secondary scored portion is opened to form said secondary opening by pulling up said pull-up end of said tab, said tab being overturnable such that said top surface of said tab facing said flat section and said push-down end being insertable into said secondary opening upon opening of said secondary opening by said tab so as to avoid interference with a portion of a person drinking from said primary opening of the can.

2. The top end of a can according to claim 1, wherein said flat section has a protrusion formed on said center portion, and said protrusion is riveted through said connecting portion of said tab so as to connect said tab to said panel in rotatable manner.

3. The top end of a can according to claim 1, wherein said secondary scored portion is formed below said tab located at said initial position.

4. The top end of a can according to claim 1, wherein said secondary scored portion is formed opposing said primary scored portion with said connecting portion of said tab disposed between said primary scored portion and said secondary scored portion.

5. The top end of a can according to claim 1, wherein said secondary scored portion has an area which is smaller than that of said primary scored portion.

6. The top end of a can according to claim 1, wherein said secondary score has a semicircular shape having a center located one of a position located at said center portion of said flat section and a position located adjacent said center of said flat section.

7. The top end of a can according to claim 1, wherein said secondary score is U-shaped and has both a bottom part and a pair of side parts, wherein said bottom part is elongated and said side parts respectively extend from said bottom part.

8. The top end of a can according to claim 7, wherein said secondary scored portion has at least one protrusion for engaging with said tab to prevent rotation of said tab.

9. The top end of a can according to claim 7, wherein said bottom part has an arc-shaped portion at the middle thereof, and said arc-shaped portion has a center located in proximity to said center portion of said flat section.

10. The top end of a can according to claim 7, wherein each of said side parts extends from each end of said bottom part in a direction extending away from said connecting portion.

11. The top end of a can according to claim 1, wherein a width dimension of said secondary scored portion is smaller than a width dimension of the tab such that said pull-down end is fixedly held in said secondary opening by an inner periphery of said secondary opening.

12. The top end of a can according to claim 11, wherein said primary score has a C-shape.

13. The top end of a can according to claim 1, wherein both said push-down end of said tab and said secondary score have semicircular shapes having centers located at said center portion of said flat section, respectively.

14. The top end of a can according to claim 1, wherein said primary score starts from a starting point adjacent to said center portion of said flat section, extends to an adjacent point of an outer periphery of said flat section, and terminates at a point adjacent to said starting point.

* * * * *